US007554255B2

(12) United States Patent
Lee et al.

(10) Patent No.: US 7,554,255 B2
(45) Date of Patent: Jun. 30, 2009

(54) ELECTRIC FIELD EMISSION DEVICE HAVING A TRIODE STRUCTURE FABRICATED BY USING AN ANODIC OXIDATION PROCESS AND METHOD FOR FABRICATING SAME

(75) Inventors: Kun-Hong Lee, Kyungsangbuk-do (KR); Sun-Kyu Hwang, Kyungsangbuk-do (KR); Soo-Hwan Jeong, Kyungsangbuk-do (KR)

(73) Assignee: Postech Foundation, Kyungsangbuk-do (KR)

( * ) Notice: Subject to any disclaimer, the term of this patent is extended or adjusted under 35 U.S.C. 154(b) by 561 days.

(21) Appl. No.: 10/522,572

(22) PCT Filed: Jul. 30, 2003

(86) PCT No.: PCT/KR03/01526

§ 371 (c)(1),
(2), (4) Date: Jan. 28, 2005

(87) PCT Pub. No.: WO2004/012218

PCT Pub. Date: Feb. 5, 2004

(65) Prior Publication Data

US 2005/0285502 A1 Dec. 29, 2005

(30) Foreign Application Priority Data

Jul. 30, 2002 (KR) ..... 10-2002-0044921
Sep. 25, 2002 (KR) ..... 10-2002-0058158

(51) Int. Cl.
*H01J 1/62* (2006.01)
*H01J 63/04* (2006.01)

(52) U.S. Cl. ..... 313/495; 313/309; 313/336; 313/351; 445/24

(58) Field of Classification Search ..... 313/495, 313/309–311, 336, 351; 445/24, 25
See application file for complete search history.

(56) References Cited

U.S. PATENT DOCUMENTS 5,397,957 A * 3/1995 Zimmerman ..... 313/309

(Continued)

FOREIGN PATENT DOCUMENTS

EP 1221710 A2 7/2002

(Continued)

OTHER PUBLICATIONS

Patent Abstracts of Japan, vol. 00, N 06; Sep. 22, 2000, & JP 2000086216 A (Tokyo Shibaura) Mar. 28, 2000, abstract, Fig. 7 and paragraphs 0049, 0050 of English translation.

*Primary Examiner*—Joseph L Williams
*Assistant Examiner*—Kevin Quarterman
(74) *Attorney, Agent, or Firm*—Bacon & Thomas, PLLC

(57) ABSTRACT

An electric field emission device having a triode structure is fabricated by using an anodic oxidation process. The device includes a supporting substrate, a bottom electrode layer to be used as an cathode electrode of the device, a gate insulating layer having a plurality of first sub-micro holes, a gate electrode layer having a plurality of second sub-micro holes connecting to the first sub-micro holes, an anode insulating layer having a plurality of third sub-micro holes connecting to the second sub-micro holes, a top electrode layer for hermetically sealing the device, the top electrode layer being used as an anode of the device and a plurality of emitters formed in the first sub-micro holes. The emitters are formed so as to come into as close contact as possible to the electrodes of the device, which results in decreasing a driving voltage.

39 Claims, 7 Drawing Sheets

U.S. PATENT DOCUMENTS

| | | | | |
|---|---|---|---|---|
| 5,866,434 | A | 2/1999 | Massey et al. | |
| 5,872,422 | A * | 2/1999 | Xu et al. | 313/311 |
| 6,203,814 | B1 | 3/2001 | Fisher et al. | |
| 6,362,011 | B1 | 3/2002 | Massey et al. | |
| 6,515,415 | B1 * | 2/2003 | Han et al. | 313/496 |
| 6,538,367 | B1 * | 3/2003 | Choi et al. | 313/309 |
| 6,645,455 | B2 | 11/2003 | Margrave et al. | |
| 6,670,747 | B2 | 12/2003 | Ito et al. | |
| 6,741,019 | B1 * | 5/2004 | Filas et al. | 313/355 |
| 6,774,548 | B2 * | 8/2004 | Fran et al. | 313/309 |
| 6,790,425 | B1 | 9/2004 | Smalley et al. | |
| 6,827,918 | B2 | 12/2004 | Margrave et al. | |
| 6,835,366 | B1 | 12/2004 | Margrave et al. | |
| 6,841,139 | B2 | 1/2005 | Margrave et al. | |
| 6,875,412 | B2 | 4/2005 | Margrave et al. | |
| 7,052,861 | B2 | 5/2006 | Massey et al. | |
| 7,252,812 | B2 | 8/2007 | Yakobson et al. | |
| 2002/0110513 | A1 | 8/2002 | Margrave et al. | |
| 2003/0090190 | A1 * | 5/2003 | Takai et al. | 313/311 |
| 2003/0143398 | A1 | 7/2003 | Ohki et al. | |
| 2004/0202603 | A1 | 10/2004 | Fisher et al. | |
| 2005/0169830 | A1 | 8/2005 | Richard et al. | |
| 2006/0049742 | A1 * | 3/2006 | Lee et al. | 313/496 |
| 2006/0160246 | A1 | 7/2006 | Massey et al. | |
| 2006/0193868 | A1 | 8/2006 | Fisher et al. | |
| 2007/0098621 | A1 | 5/2007 | Margrave et al. | |
| 2008/0210370 | A1 | 9/2008 | Smalley et al. | |

FOREIGN PATENT DOCUMENTS

| | | | |
|---|---|---|---|
| JP | 2000-243247 | | 9/2000 |
| JP | 2002-503204 | | 1/2002 |
| KR | 20010058663 | A | 7/2001 |
| KR | 20010068389 | A | 7/2001 |
| KR | 10-2002-0041665 | * | 3/2002 |
| KR | 20020041665 | A | 6/2002 |
| WO | WO 92/00203 | | 2/1992 |
| WO | WO 00/17101 | A1 | 3/2000 |
| WO | WO 01/30694 | A1 | 5/2001 |

* cited by examiner

ELECTRIC FIELD EMISSION DEVICE HAVING A TRIODE STRUCTURE FABRICATED BY USING AN ANODIC OXIDATION PROCESS AND METHOD FOR FABRICATING SAME

TECHNICAL FIELD

The present invention relates to an electric field emission device and a method for fabricating same; and, more particularly, to an electric field emission device having a triode structure fabricated by using an anodic oxidation process and a method for fabricating same.

BACKGROUND ART

In general, an electric field emission device means a device where electrons are emitted from a surface of metal or semiconductor in a vacuum in accordance with tunneling effect caused by applying electronic field having high intensity to the surface. Such an electric field emission device may be utilized as a high-speed switching device, a microwave generator, an amplifier or a display device. In the device, the emitted electrons can induce high power at a high frequency in a vacuum with low energy loss. Further, the device has several advantages that it has a shorter response time than a conventional solid-state device and may be integrated on a single silicon chip.

FIG. 1 illustrates a cross-sectional view of a conventional "Spindt" type electric field emission device having a triode structure fabricated by using an electron beam photolithographic process.

Referring to FIG. 1, the electric field emission device is fabricated as follows. That is, on a glass or a silicon substrate 100, a cathode layer 102, a resistive layer 104, an insulating layer 106 and a gate electrode layer 108 are formed sequentially. And then, photosensitive film patterns, each having a diameter of micrometer, are formed on the gate electrode 108 by using a photolithographic process. Thereafter, the insulating layer 106 is etched by using a reactive ion etching technique such that a surface of the resistive layer 104 is exposed. Subsequently, a metal electric field emission tip 110 containing material such as Mo, W and Cr is vertically deposited on the resistive layer 104 to have a conical shape by using an electron beam evaporation technique.

As mentioned above, the Spindt type electric field emission device has advantages that it has a shorter response time than a conventional solid-state device and may be integrated on a single silicon chip. However, it is difficult to arrange a plurality of micro holes at regular intervals on the electric field emission device as shown in FIG. 1, particularly when an area of the surface of the device is large. Further, since a distance between an electric field emission tip and an anode electrode is several hundreds micrometers, the electric field emission device as shown in FIG. 1 has a disadvantage that it requires a high driving voltage. Furthermore, there may be needed an additional process to form micro holes, each having a sub-micrometer diameter, on the surface of the gate electrode layer 108.

DISCLOSURE OF THE INVENTION

It is, therefore, an object of the present invention to provide an electric field emission device having a triode structure wherein an array of gate holes, each having a sub-micrometer diameter, are formed thereon by using an anodic oxidation process, to thereby facilitate an arrangement of the gate holes at regular intervals even on a large area, and emitter tips are formed to get a close contact to electrodes, to thereby decrease a driving voltage for the device.

In accordance with one aspect of the present invention, there is provided an electric field emission device having a triode structure fabricated by using an anodic oxidation process, comprising: a supporting substrate; a bottom electrode layer formed on the supporting substrate, which is used as an cathode electrode of the device; a gate insulating layer formed on the bottom electrode layer, having a plurality of first sub-micro holes to be used as gate holes of the device; a gate electrode layer formed on the gate insulating layer, having a plurality of second sub-micro holes each connecting to a corresponding one of the first sub-micro holes; an alumina layer formed on the gate electrode layer, having a plurality of third sub-micro holes each connecting to a corresponding one of the second sub-micro holes; a top electrode layer for hermetically sealing the device in a vacuum, which is formed on the alumina layer and used as an anode of the device; and a plurality of emitters for emitting electrons in a high electric field, each of the emitters being formed in a corresponding one of the first sub-micro holes.

In accordance with another aspect of the present invention, there is provided an electric field emission device having a triode structure fabricated by using an anodic oxidation process, comprising: a supporting substrate; a bottom electrode layer formed on the supporting substrate, which is used as an cathode electrode of the device; a gate insulating layer formed on the bottom electrode layer, having a plurality of first sub-micro holes to be used as gate holes of the device; a gate electrode layer formed on the gate insulating layer, the gate electrode layer having a plurality of second sub-micro holes each connecting to a corresponding one of the first sub-micro holes; an anode insulating layer formed on the gate electrode layer, having a plurality of third sub-micro holes each connecting to a corresponding one of the second sub-micro holes; a top electrode layer for hermetically sealing the device in a vacuum, which is formed on the anode insulating layer and used as an anode of the device; and a plurality of emitters for emitting electrons in a high electric field, each of the emitters being formed in a corresponding one of the first sub-micro holes.

In accordance with still another aspect of the present invention, there is provided a method for fabricating an electric field emission device having a triode structure by using an anodic oxidation process, comprising the steps of: (a) forming a bottom electrode layer on a supporting substrate, the bottom electrode layer being used as an cathode electrode of the device; (b) forming sequentially a gate insulating layer, a gate electrode layer and an aluminum layer on the bottom electrode layer; (c) forming a plurality of first sub-micro holes in an alumina layer by performing an anodic oxidation process on the aluminum layer, thereby transforming the aluminum layer into the alumina layer; (d) etching a barrier layer of the alumina layer and the gate electrode layer, thereby a surface of the gate insulating layer being exposed through the first sub-micro holes; (e) forming a plurality of second sub-micro holes in the gate insulating layer, thereby each of the first sub-micro holes connecting to a corresponding one of the second sub-micro holes; (f) forming an emitter for emitting electron in a high electric field in each of the second sub-micro holes; and (g) forming a top electrode layer for hermetically sealing the device on the alumina layer in a vacuum, the top electrode layer being used as an anode of the device.

In accordance with still another aspect of the present invention, there is provided a method for fabricating an electric field emission device having a triode structure by using an anodic oxidation process, comprising the steps of: (a) forming a bottom electrode layer on a supporting substrate, the bottom electrode layer being used as an cathode electrode of the device; (b) forming sequentially a gate insulating layer, a gate electrode layer, an anode insulating layer and an aluminum layer on the bottom electrode layer; (c) forming a plurality of first sub-micro holes in an alumina layer by performing an anodic oxidation process on the aluminum layer, thereby transforming the aluminum layer into the alumina layer; (d) etching an barrier layer of the alumina layer, the anode insulating layer and the gate electrode layer, thereby a surface of the gate insulating layer being exposed through the first sub-micro holes; (e) forming a plurality of second sub-micro holes in the gate insulating layer, thereby each of the first sub-micro holes connecting to a corresponding one of the second sub-micro holes; (f) removing the alumina layer; (g) forming an emitter for emitting electron in a high electric field in each of the second sub-micro holes; and (h) forming a top electrode layer for hermetically sealing the device on the anode insulating layer in a vacuum, the top electrode layer being used as an anode of the device.

BRIEF DESCRIPTION OF DRAWINGS

The above and other objects and features of the present invention will become apparent from the following description of preferred embodiments, given in conjunction with the accompanying drawings, in which.

BEST MODE FOR CARRYING OUT THE INVENTION

FIGS. 2A to 2F present cross-sectional views of devices, each of which is fabricated in each step of a method for fabricating an electric field emission device having a triode structure by using an anodic oxidation process in accordance with a first preferred embodiment of the present invention. In the following, the method in accordance with the first preferred embodiment of the present invention will be described in detail.

Figure 1:
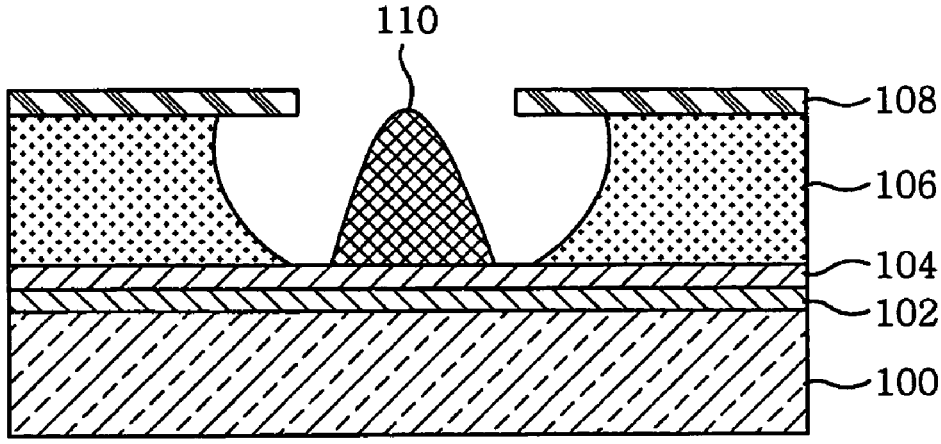
FIG. 1 (PRIOR ART)
FIG. 1 illustrates a cross-sectional view of a conventional electric field emission device having a triode structure fabricated by using an electron beam photolithographic process.
Figure 2A:
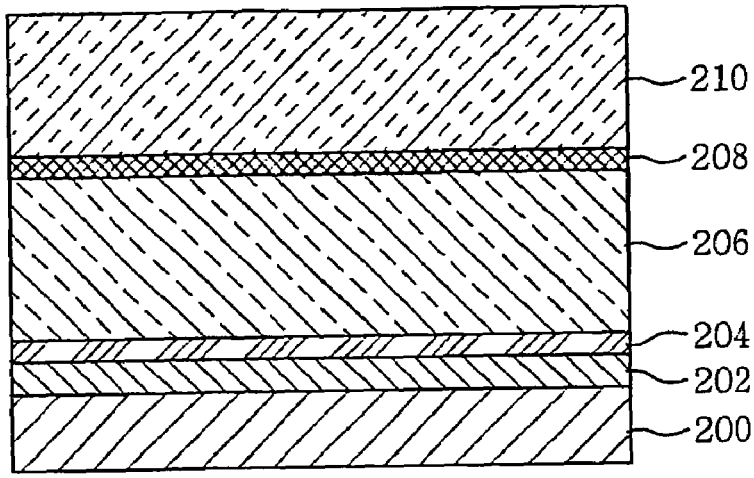
FIGS. 2A to 2F describe cross-sectional views of an electric field emission device having a triode structure fabricated by using an anodic oxidation process in accordance with a first preferred embodiment of the present invention.

First, as shown in FIG. 2A, the bottom electrode layer 202 containing, e.g., W, Cr, Nb, Al, Ti or alloy thereof is formed on the supporting substrate 200 containing non-conducting material such as glass, e.g., by using a sputtering method or an electron beam deposition method. Instead of the above-mentioned metal, the bottom electrode layer 202 may contain conductive polymer substance, metallic oxide, metallic nitride or metallic sulfide. The thickness of the bottom electrode layer 202 is preferably about 2000 Å.

Thereafter, the resistive layer 204 and the gate insulating layer 206 are sequentially formed on the bottom electrode layer 202 by using the LPCVD method or a reactive sputtering method. Herein, the resistive layer 204 and the gate insulating layer 206 may contain $SiO_2$ or metallic oxide. Further, the thickness of the resistive layer 204 preferably ranges about from 10 Å to several tens Å.

In the meantime, although the resistive layer 204 has been described to be formed between the gate insulating layer 206 and the bottom electrode layer 202, the formation of the resistive layer 204 may be omitted.

Then, on the gate insulating layer 206, the gate electrode layer 208 containing one of Au, W, Nb, Cr, Al and Ti and the aluminum layer 210 are sequentially formed by using a sputtering method. Instead of the above-mentioned metal, the gate electrode layer 208 may contain conductive polymer material, metallic oxide, metallic nitride and metallic sulfide. The thickness of each of the gate insulating layer 206 and the aluminum layer 210 is preferably about 500 nm.

Figure 2B:
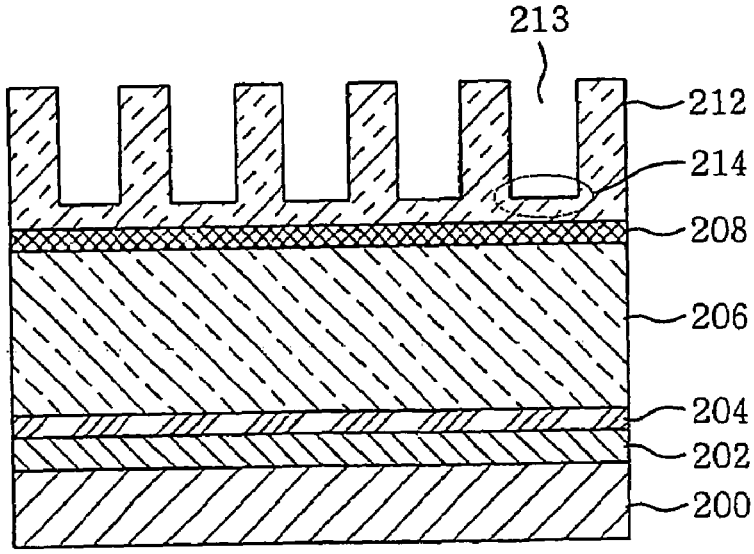

Next, as shown in FIG. 2B, the aluminum layer 210 is processed by using an anodic oxidation process to become an alumina layer 212 having sub-micro holes 213 therein. The anodic oxidation process is performed as follows. That is, a surface of the aluminum layer 210 is polished by using an electropolishing method. The aluminum layer 210 is then dipped in a solution of phosphoric acid, oxalic acid, chromic acid or sulfuric acid and a DC voltage ranging about from 10 V to 200 V is applied thereto, thereby forming the alumina layer 212 having the sub-micro holes 213 therein. In particular, it is preferable to apply a DC voltage of 25 V, 40 V or 195 V to the aluminum layer 210 in order to form the sub-micro holes in the form of a honeycomb.

Figure 2C:
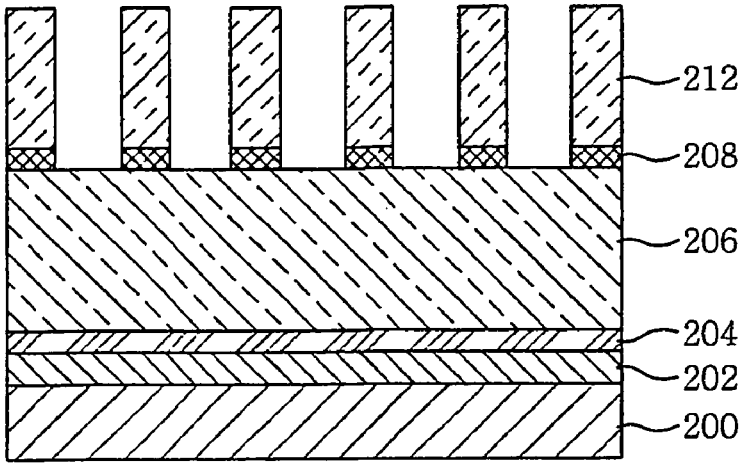

Subsequently, as shown in FIG. 2C, the barrier layer 214 of the alumina layer 212 and the gate electrode layer 208 is dry-etched by using a reactive ion etching method in an atmosphere of a gas mixture of $CF_4$ and $O_2$, such that a surface of the gate insulating layer 206 is exposed. Alternatively, the barrier layer 214 of alumina layer 212 and the gate electrode layer 208 may be etched by using ion milling or wet etching techniques.

Figure 2D:
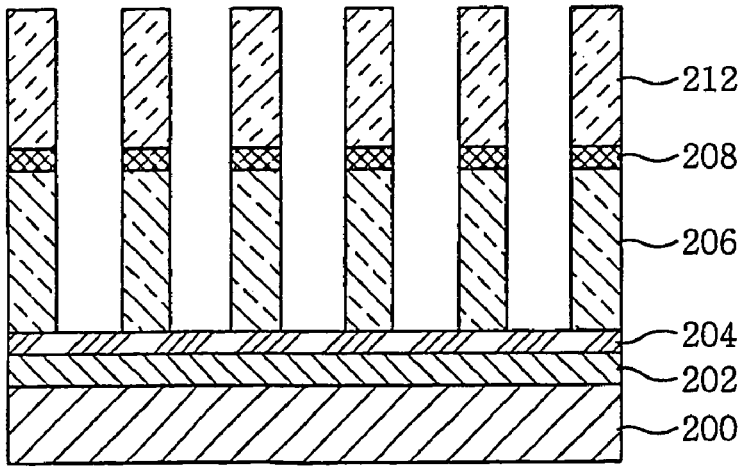

Then, as illustrated in FIG. 2D, the gate insulating layer 206 is etched to have sub-micro holes therein connecting to the corresponding holes of the alumina layer 212. In etching the gate insulating layer 206, there may be employed one of ion milling, dry etching, wet etching and anodic oxidation techniques. Each of thus formed sub-micro holes preferably has a depth ranging about from 500 nm to 1 μm.

Figure 2E:
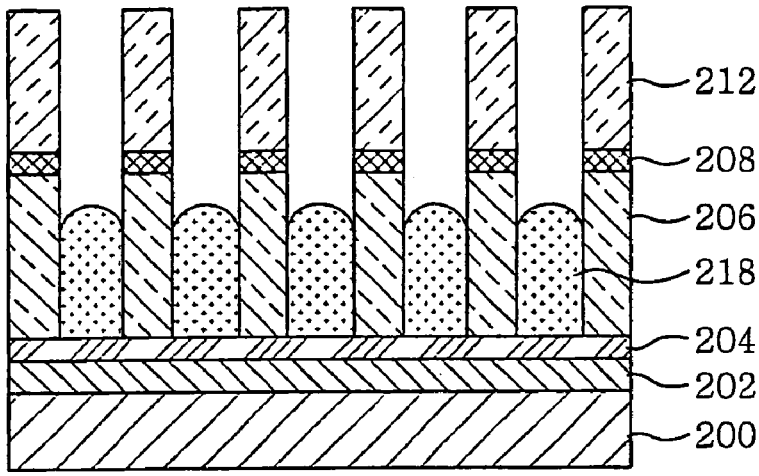

Thereafter, as shown in FIG. 2E, emitters 218 are formed in the holes of the gate insulating layer 206. The emitters 218 may be formed by growing metal from bottoms of the holes or by attaching metal to bottoms of the holes. In this case, the emitters 218 is preferably formed to come into as close contact as possible to the gate electrode layer 208, which results in decreasing a driving voltage for the electric field emission device of the present invention.

The growth of the metal in the holes is performed by applying DC or AC voltage (or current) or voltage (or current) pulse to the structure (e.g., the bottom electrode layer 202) shown in FIG. 2D in a solution of metal sulfate, metal nitrate or metal chloride. The height of the growing metal depends on a time period of applying the voltage. Further, the process of growing the metal may be carried out after chemically activating surfaces of the bottoms of the holes. Herein, the metal used in forming the emitters 218 may contain, e.g., Au, Pt, Ni, Mo, W, Ta, Cr, Ti, Co, Cs, Ba, Hf, Nb, Fe, Rb or alloy thereof.

On the other hand, the emitters 218 may be formed by using a carbon nano-structure such as a carbon nano-tube, a carbon nano-fiber, a carbon nano-particle and an amorphous carbon material. Particularly, it is preferable that the carbon nano-tube is used as the emitters 218 since it has such desirable characteristics as high mechanical solidity, high chemical stability and high field enhancement factor.

In the first embodiment of the present invention, the carbon nano-tubes to be used as the emitters 218 may be formed by decomposing thermally or in plazma a gas mixture of hydrocarbon, carbon monoxide, hydrogen and so on at about 200-800° C.

Alternatively, the emitters 218 may be grown in the holes, e.g., by thiolizing a pre-synthesized carbon nano-tube and applying thereto an Au-S chemical composition process. That is, the pre-systhesized carbon nano-tube is dipped into an acid solution and then into a solution containing a group including sulfur, such that a functional group containing sulfur (S) is attached to the carbon nano-tube. Then, the sulfur (S) attached to the carbon nano-tube is coupled to gold formed on a surface of the bottoms of the holes.

The process of growing the carbon nano-tube may utilize the above-described metal growing process to form catalytic metal on the surface of the bottoms of the holes. In this case, the catalytic metal is used to crack a hydrocarbon gas. Otherwise, the emitters may be formed by performing an electrodephoresis process on a pre-synthesized carbon nano-structure.

Although, in this embodiment, only one emitter 218 is formed in each of the holes of the gate insulating layer 206, more than one emitter 218 may be formed in each of the holes. Further, the emitters 218 may be composed by using semiconductor material such as GaN, $TiO_2$ and CdS.

Figure 2F:
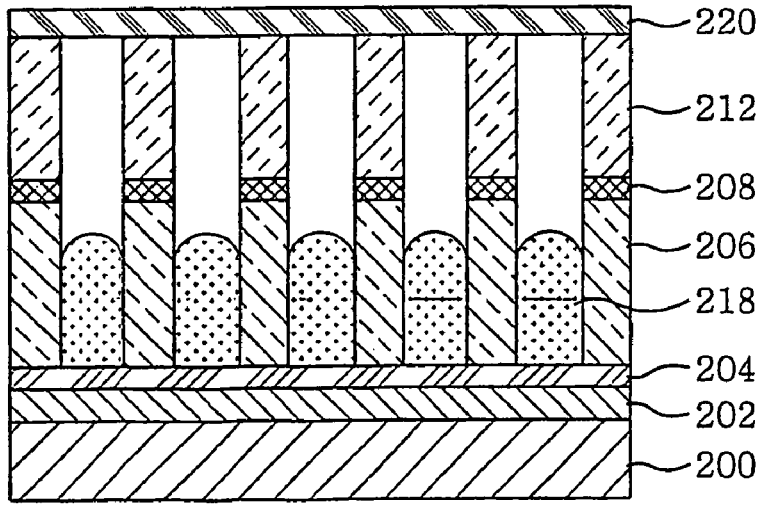

Finally, as shown in FIG. 2F, a top electrode layer 220 is formed on the structure shown in FIG. 2E. The top electrode layer 220 is used as an anode of the electric field emission device and also hermetically seals the triode structure fabricated as shown in FIG. 2E.

The top electrode layer 220 may be formed by depositing metal in a vacuum by employing one of electron beam deposition, thermal deposition, sputtering, LPCVD (low pressure chemical vapor deposition), sol-gel composition, electroplating and electroless plating techniques. The metal used in forming the top electrode layer 220 may be, e.g., Ti, Nb, Mo or Ta, which is generally used as a getter. Otherwise, the top electrode layer 220 may contain one of Al, Ba, V, Zr, Cr, W, conductive polymer material, metallic oxide, metallic nitride and metallic sulfide. Further, the thickness of the top electrode layer 220 preferably ranges about from 300 nm to 1 μm.

In the meantime, FIGS. 3A to 3F describe cross-sectional views of an electric field emission device having a triode structure fabricated by using an anodic oxidation process in accordance with a second preferred embodiment of the present invention.

The second embodiment of the present invention has the same configuration as the first embodiment of the present invention, which is shown in FIGS. 2A to 2F, except that there is formed an anode insulating layer 211 in stead of the alumina layer 212.

In the following, a process of fabricating the electric field emission device in accordance with the second embodiment of the present invention will be described in detail.

Figure 3A:
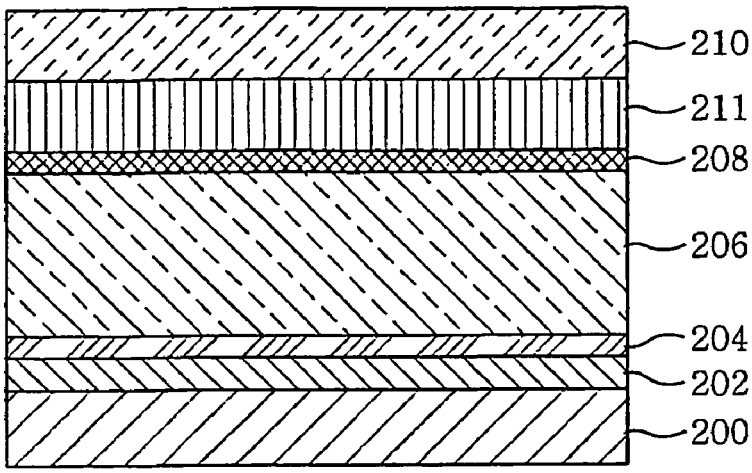
FIGS. 3A to 3F exhibit cross-sectional views of an electric field emission device having a triode structure fabricated by using an anodic oxidation process in accordance with a second preferred embodiment of the present invention.

First, as shown in FIG. 3A, a bottom electrode layer 202, a resistive layer 204 and a gate insulating layer 206 are formed on a supporting substrate 200. Although the resistive layer 204 has been described to be formed between the gate insulating layer 206 and the bottom electrode layer 202, the formation of the resistive layer 204 may be omitted. Then, on the gate insulating layer 206, a gate electrode layer 208, an anode insulating layer 211 and an aluminum layer 210 are sequentially formed.

Herein, processes of forming the above-mentioned layers and material contained therein are the same as those described with reference to FIG. 2A except those for the anode insulating layer 211. The anode insulating layer 211 is formed by performing one of electron beam deposition, thermal deposition, sputtering, LPCVD (low pressure chemical vapor deposition), sol-gel composition, electroplating and electroless plating techniques. The anode insulating layer 211 may contain $SiO_2$ or metallic oxide and is preferably about 500 nm in thickness. Further, in etching the anode insulating layer 211, there may be employed one of ion milling, dry etching, wet etching and anodic oxidation techniques.

Figure 3B:
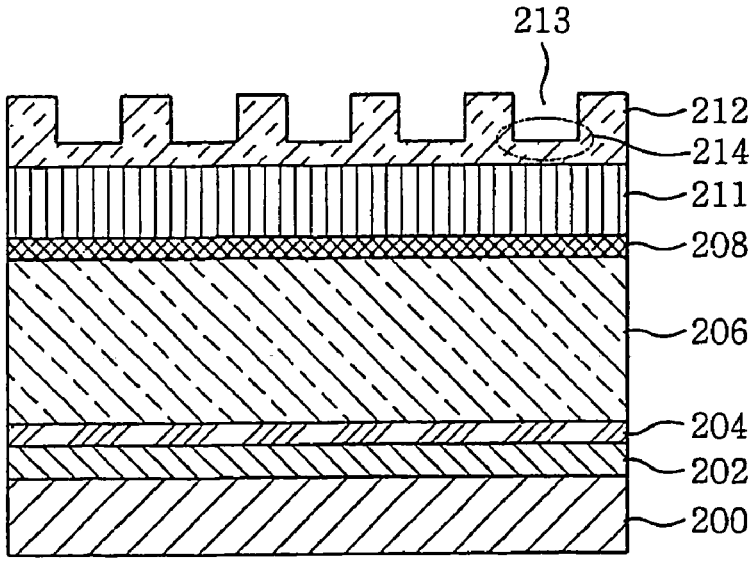

Next, as shown in FIG. 3B, the aluminum layer 210 is processed by using an anodic oxidation process to become an alumina layer 212 having sub-micro holes 213 therein.

Figure 3C:
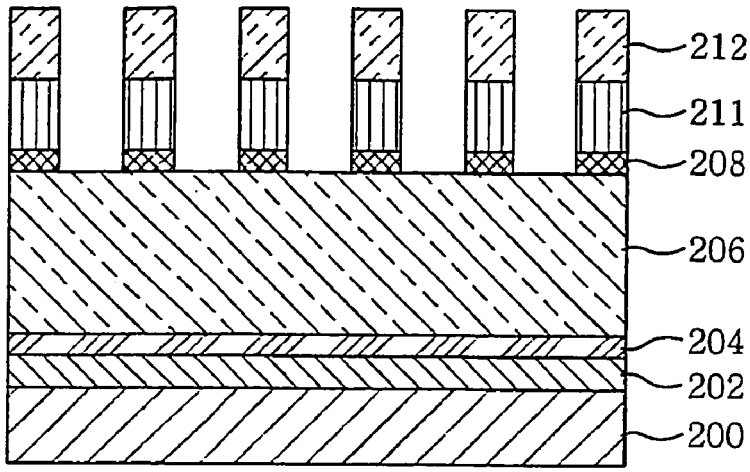
Figure 3D:
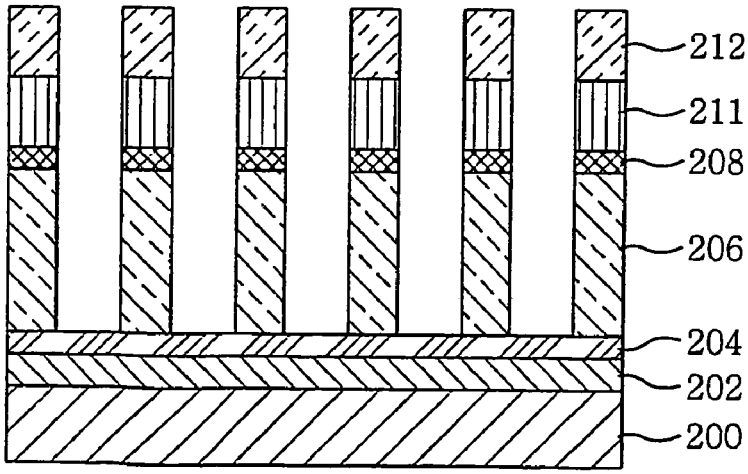

Subsequently, as shown in FIG. 3C, a barrier layer 214 of the alumina layer 212, the anode insulating layer 211 and the gate electrode layer 208 is dry-etched. Then, as illustrated in FIG. 3D, the gate insulating layer 206 is etched to have sub-micro holes therein connecting to the corresponding holes of the alumina layer 212.

Figure 3E:
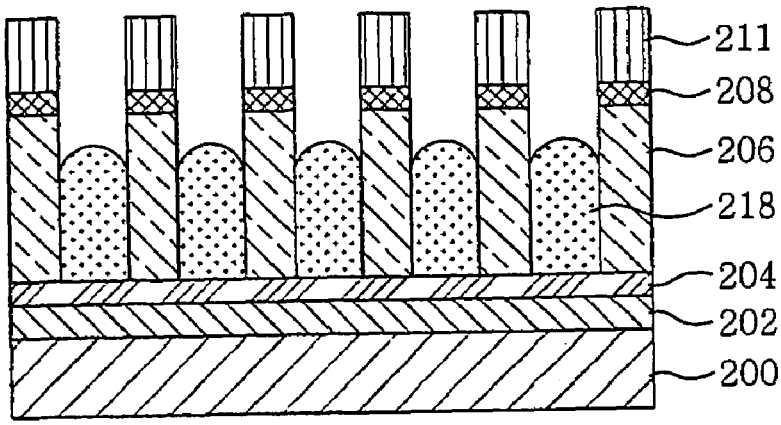

Thereafter, as shown in FIG. 3E, the alumina layer 212 is removed and then emitters 218 are formed in the holes of the gate insulating layer 206. The process of removing the alumina layer 212 may be carried out by dipping the alumina layer 212 in a solution of phosphoric acid or a mixed solution of phosphoric acid and chromic acid.

Figure 3F:
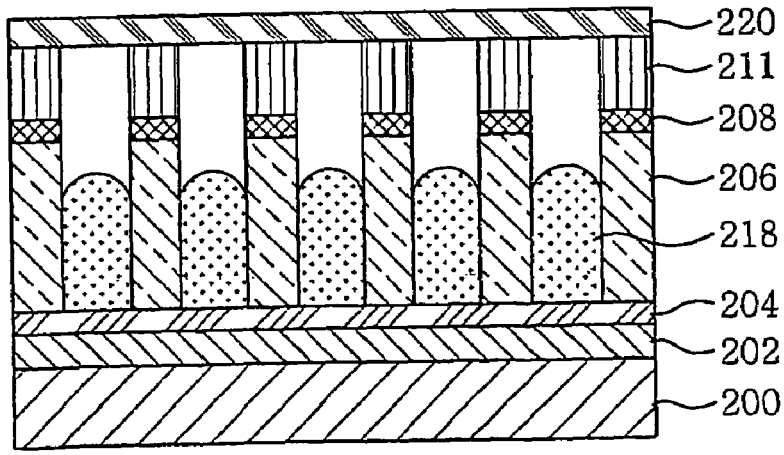

Finally, as shown in FIG. 3F, a top electrode layer 220 is formed on the structure as shown in FIG. 3E. The top electrode layer 220 is used as an anode of the electric field emission device and also hermetically seals the triode structure fabricated as shown in FIG. 3E.

Even though the detailed descriptions on material contained in the layers, the processes of fabricating the layers and the dimensions of the layers are not given in the above with reference to FIGS. 3A to 3F, throughout the several views in the accompanying drawings, like reference numerals designate corresponding parts and thus the descriptions given with reference to FIGS. 2A to 2F are also applicable to the corresponding parts shown in FIGS. 3A to 3F.

While the invention has been shown and described with respect to the preferred embodiments, it will be understood by those skilled in the art that various changes and modifications may be made without departing from the spirit and scope of the invention as defined in the following claims.

The invention claimed is:

1. An electric field emission device having a triode structure fabricated by using an anodic oxidation process, comprising:

a supporting substrate;

a bottom electrode layer formed on the supporting substrate, which is used as a cathode electrode of the device;

a gate insulating layer formed on the bottom electrode layer, the gate insulating layer having a plurality of first sub-micro holes to be used as gate holes of the device;

a gate electrode layer formed on the gate insulating layer, the gate electrode layer having a plurality of second sub-micro holes each connecting to a corresponding one of the first sub-micro holes;

an alumina layer formed on the gate electrode layer, the alumina layer having a plurality of third sub-micro holes each connecting to a corresponding one of the second sub-micro holes, wherein the alumina layer and the plurality of third sub-micro holes are formed by the anodic oxidation process;

a top electrode layer for hermetically sealing the device in a vacuum, which is formed on the alumina layer and used as an anode of the device, wherein the top electrode layer is formed by depositing metal in a vacuum by employing one of electron beam deposition, thermal deposition, sputtering, low pressure chemical vapor deposition, sol-gel composition, electroplating and electoless plating; and a plurality of emitters for emitting electrons in a high electric field, each of the emitters being formed in a corresponding one of the first sub-micro holes.

2. The device of claim 1, wherein the emitter contains metal, semiconductor or carbon material.

3. The device of claim 2, wherein the carbon material is selected from a group consisting of a carbon nano-fiber, a carbon nano-tube, a carbon nano-particle and amorphous carbon material.

4. The device of claim 1, further comprising a resistive layer formed between the bottom electrode layer and the gate insulating layer.

5. The device of claim 4, wherein, the resistive layer contains $SiO_2$ or metallic oxide.

6. An electric field emission device having a triode structure fabricated by using an anodic oxidation process, comprising:

a supporting substrate;

a bottom electrode layer formed on the supporting substrate, which is used as a cathode electrode of the device;

a gate insulating layer formed on the bottom electrode layer, having a plurality of first sub-micro holes to be used as gate holes of the device;

a gate electrode layer formed on the gate insulating layer, the gate electrode layer having a plurality of second sub-micro holes each connecting to a corresponding one of the first sub-micro holes;

an anode insulating layer formed on the gate electrode layer, having a plurality of third sub-micro holes each connecting to a corresponding one of the second sub-micro holes, wherein the anode insulating layer is formed by performing one of electron beam deposition, thermal deposition, sputtering, low pressure chemical vapor deposition, sol-gel composition, electroplating and electroless plating;

a top electrode layer for hermetically sealing the device in a vacuum, which is formed on the anode insulating layer and used as an anode of the device, wherein the top electrode layer is formed by depositing metal in a vacuum by employing one of electron beam deposition, thermal deposition, sputtering, low pressure chemical vapor deposition, sol-gel composition, electroplating and electoless plating; and a plurality of emitters for emitting electrons in a high electric field, each of the emitters being formed in a corresponding one of the first sub-micro holes.

7. The device of claim 6, wherein the emitter contains metal, semiconductor or carbon material.

8. The device of claim 7, wherein the carbon material is selected from a group consisting a carbon nano-fiber, a carbon nano-tube, a carbon nano-particle and amorphous carbon material.

9. The device of claim 6, further comprising a resistive layer formed between the bottom electrode layer and the gate insulating layer.

10. The device of claim 9, wherein the resistive layer contains $SiO_2$ or metallic oxide.

11. A method for fabricating an electric field emission device having a triode structure by using an anodic oxidation process, comprising the steps of:

(a) forming a bottom electrode layer on a supporting substrate, the bottom electrode layer being used as a cathode electrode of the device;

(b) forming sequentially a gate insulating layer, a gate electrode layer and an aluminum layer on the bottom electrode layer;

(c) forming a plurality of first sub-micro holes in an alumina layer by performing an anodic oxidation process on the aluminum layer, thereby transforming the aluminum layer into the alumina layer;

(d) etching a barrier layer of the alumina layer and the gate electrode layer, thereby a surface of the gate insulating layer being exposed through the first sub-micro holes;

(e) forming a plurality of second sub-micro holes in the gate insulating layer, thereby each of the first sub-micro holes connecting to a corresponding one of the second sub-micro holes;

(f) forming an emitter for emitting electron in a high electric field in each of the second sub-micro holes; and (g) forming a top electrode layer for hermetically sealing the device on the alumina layer in a vacuum, the top electrode layer being used as an anode of the device.

12. The method of claim 11, wherein, in the step (c), the anodic oxidation process is performed by using an electrolyte selected from a group consisting of oxalic acid, sulfuric acid, phosphoric acid and chromic acid.

13. The method of claim 11, wherein, in the step (d), the barrier layer of the alumina layer and the gate electrode layer are etched by using one of ion milling, dry etching and wet etching techniques.

14. The method of claim 11, wherein, in the step (e), the gate insulating layer is etched by using one of ion milling, dry etching, wet etching and anodic oxidation techniques.

15. The method of claim 11, wherein, in the step (f), each of the emitters is formed by growing metal from a bottom of each of the second sub-micro holes.

16. The method of claim 15, wherein the metal is grown by applying DC or AC voltage (or current) or voltage (or current) pulse to a solution of metal sulfate, metal nitrate or metal chloride.

17. The method of claim 15, wherein the metal is grown by using a solution of metal sulfate, metal nitrate or metal chloride after chemically activating a surface of the bottom.

18. The method of claim 11, wherein, in the step (f), each of the emitters is formed by attaching metal to a bottom of each of the second sub-micro holes.

19. The method of claim 11, wherein, in the step (f), each of the emitters is formed by forming a carbon nano-structure on a bottom of each of the second sub-micro holes.

20. The method of claim 19, wherein the carbon nano-structure is one of carbon nano-tube, carbon nano-fiber, amorphous carbon and carbon nano-particle, which are composed by using a thermal decomposition.

21. The method of claim 20, wherein the thermal decomposition is performed by thermally decomposing a gas mixture of hydrocarbon, carbon monoxide and hydrogen at 200-800° C.

22. The method of claim 19, wherein the carbon nano-structure is one of carbon nano-tube, carbon nano-fiber, amorphous carbon and carbon nano-particle, which are composed by using a plasma decomposition.

23. The method of claim 11, wherein, in the step (f), each of the emitters is formed by thiolizing a pre-synthesized carbon nano-tube and applying thereto an Au-S chemical composition process.

24. The method of claim 11, wherein, in the step (f), each of the emitters is formed by performing an electrodephoresis process on a pre-synthesized carbon nano-structure.

25. The method of claim 11, wherein, in the step (f), more than one emitter is formed in each of the second sub-micro holes.

26. A method for fabricating an electric field emission device having a triode structure by using an anodic oxidation process, comprising the steps of:

(a) forming a bottom electrode layer on a supporting substrate, the bottom electrode layer being used as a cathode electrode of the device;

(b) forming sequentially a gate insulating layer, a gate electrode layer, an anode insulating layer and an aluminum layer on the bottom electrode layer;

(c) forming a plurality of first sub-micro holes in an alumina layer by performing an anodic oxidation process on the aluminum layer, thereby transforming the aluminum layer into the alumina layer;

(d) etching an barrier layer of the alumina layer, the anode insulating layer and the gate electrode layer, thereby a surface of the gate insulating layer being exposed through the first sub-micro holes;

(e) forming a plurality of second sub-micro holes in the gate insulating layer, thereby each of the first sub-micro holes connecting to a corresponding one of the second sub-micro holes;

(f) removing the alumina layer;

(g) forming an emitter for emitting electron in a high electric field in each of the second sub-micro holes; and (h) forming a top electrode layer for hermetically sealing the device on the anode insulating layer in a vacuum, the top electrode layer being used as an anode of the device.

27. The method of claim 26, wherein, in the step (c), the anodic oxidation process is performed by using an electrolyte selected from a group consisting of oxalic acid, sulfuric acid, phosphoric acid and chromic acid.

28. The method of claim 26, wherein, in the step (f), the alumina layer is removed by dipping the alumina layer in a solution of phosphoric acid or a mixed solution of phosphoric acid and chromic acid.

29. The method of claim 26, wherein, in the step (g), each of the emitters is formed by growing metal from a bottom of each of the second sub-micro holes.

30. The method of claim 29, wherein the metal is grown by applying DC or AC voltage (or current) or voltage (or current) pulse to a solution of metal sulfate, metal nitrate or metal chloride.

31. The method of claim 29, wherein the metal is grown by using a solution of metal sulfate, metal nitrate or metal chloride after chemically activating a surface of the bottom.

32. The method of claim 26, wherein, in the step (g), each of the emitters is formed by attaching metal to a bottom of each of the second sub-micro holes.

33. The method of claim 26, wherein, in the step (g), each of the emitters is formed by forming a carbon nano-structure on a bottom of each of the second sub-micro holes.

34. The method of claim 33, wherein the carbon nano-structure is one of carbon nano-tube, carbon nano-fiber, amorphous carbon and carbon nano-particle, which are composed by using a thermal decomposition.

35. The method of claim 34, wherein the thermal decomposition is performed by thermally decomposing a gas mixture of hydrocarbon, carbon monoxide and hydrogen at 200-800° C.

36. The method of claim 33, wherein the carbon nano-structure is one of carbon nano-tube, carbon nano-fiber, amorphous carbon and carbon nano-particle, which are composed by using a plasma decomposition.

37. The method of claim 26, wherein, in the step (g), each of the emitters is formed by thiolizing a pre-synthesized carbon nano-tube and applying thereto an Au-S chemical composition process.

38. The method of claim 26, wherein, in the step (g), each of the emitters is formed by performing an electrodephoresis process on a pre-synthesized carbon nano-structure.

39. The method of claim 26, wherein, in the step (g), more than one emitter is formed in each of the second sub-micro holes.

* * * * *